United States Patent [19]

Liberman

[11] 4,138,636

[45] Feb. 6, 1979

[54] VOLTAGE REGULATING TRANSFORMER HAVING EI LAMINATIONS AND TWO CENTER LEGS OF DIFFERENT RELUCTANCE

[75] Inventor: Arnold J. Liberman, Skokie, Ill.

[73] Assignee: Zenith Radio Corporation, Glenview, Ill.

[21] Appl. No.: 805,685

[22] Filed: Jun. 13, 1977

[51] Int. Cl.[2] ..... G05F 3/02; H01F 39/00

[52] U.S. Cl. ..... 323/45; 323/48; 323/56; 336/155; 336/178; 336/215

[58] Field of Search ..... 323/44 R, 45, 48, 56, 323/83; 336/155, 165, 170, 178, 212, 214, 215

[56] References Cited

U.S. PATENT DOCUMENTS

| | | | |
|---|---|---|---|
| 3,172,031 | 3/1965 | Sola | 323/45 |
| 3,436,692 | 4/1969 | Walters | 323/48 |
| 3,546,571 | 12/1970 | Fletcher et al. | 336/165 |
| 3,659,191 | 4/1972 | Spreadbury | 323/56 |
| 3,710,233 | 1/1973 | Borkovitz | 323/48 |

FOREIGN PATENT DOCUMENTS

| | | | |
|---|---|---|---|
| 18280 of | 1912 | United Kingdom | 323/56 |

*Primary Examiner*—Gerald Goldberg
*Attorney, Agent, or Firm*—Nicholas A. Camasto

[57] ABSTRACT

A shell-type voltage regulating transformer includes a magnetic core comprising a stack of modified EI laminations having a center leg forming two sections. One of the center leg sections defines a low reluctance magnetically saturable path while the other section defines a high reluctance non-saturating path. A primary winding is wound on the center leg for magnetically coupling with both sections and a pair of secondary windings are wound each for magnetically coupling with only one of the sections. The two secondary windings are connected in series opposing relationship to supply a substantially constant voltage to a load.

7 Claims, 5 Drawing Figures

VOLTAGE REGULATING TRANSFORMER HAVING EI LAMINATIONS AND TWO CENTER LEGS OF DIFFERENT RELUCTANCE

BACKGROUND OF THE INVENTION

The present invention relates generally to voltage regulating apparatus. More particularly, the present invention relates to shell-type voltage regulating transformers of the type using saturating reactors to achieve voltage regulation.

Voltage regulating transformers are commonly used to supply a substantially constant voltage to a load over a relatively wide range of input voltage variations. Frequently, such transformers employ the expedient of a saturating reactor to facilitate the voltage regulating function. Conventionally, the saturating-transformer voltage regulator comprises a magnetic core including a primary winding connected to a suitable supply of unregulated input voltage and a pair of secondary windings connected in series opposing relationship across the load. Sometimes, one of the secondary windings is eliminated by connecting the primary winding in an autotransformer configuration. Examples of such devices are disclosed in U.S. Pat. Nos. 2,143,745 and 2,212,198 to Sola and in a July, 1937 article in *Electronics Magazine,* pages 14–16, entitled "Voltage Regulators Using Magnetic Saturation".

In the prior art saturating reactor transformers, the magnetic core is normally structured having a saturating core section and a high reluctance non-saturating section. The saturating core section may, for example, comprise a core section of narrowed cross-sectional dimension or, alternatively, saturation may be facilitated through the use of a resonant circuit as taught in the foregoing Sola patents. An air-gap is frequently provided in the non-saturating core section to increase its reluctance. In any event, as the input voltage supplied to the primary winding rises from zero, most of the resulting flux is coupled through the saturating core section due to its relatively low reluctance and transformed by one of the secondary windings into a voltage for application to the load. When the input voltage increases to a level sufficient to saturate the core section, the flux divides more equally between the saturating and non-saturating core sections due to the effective increase in reluctance of the saturated core section. While saturated, the core section operates above the knee of the magnetization curve thereby opposing any further increase in flux. Consequently, a large change in primary voltage produces a relatively small variation in the secondary voltage. The remaining secondary winding may be coupled to the non-saturating core section and connected in series opposing relationship with the first secondary winding for transforming the flux in the non-saturating core section into a voltage further reducing the total amount of output voltage variation.

While voltage regulating transformers of the foregoing type exhibit numerous desirable features, e.g. rapid response, simplicity and lack of adjustments and self-protection against overloads, they are also characterized by certain design deficiencies. In particular, the presence of a highly saturated magnetic core in the regulator produces a considerable stray magnetic field with a high harmonic content. These stray magnetic fields may severely interfere with the operation of the equipment with which the regulator is used and in fact, may mitigate against the use of the regulator at all.

Furthermore, while the regulator may theoretically be shielded to reduce the deleterious effect of the stray magnetic field, prior art attempts in this regard have generally proven impracticable on the basis of cost and complexity considerations.

SUMMARY OF THE INVENTION

It is in general an object of the present invention to provide a novel and improved saturating reactor voltage-regulating transformer.

It is a further object of the present invention to provide a shell-type voltage regulating transformer producing relatively insignificant stray magnetic fields and which is simple and inexpensive to manufacture.

In accordance with the foregoing and other useful objects, a shell-type voltage regulating transformer according to the present invention includes a magnetic core comprising a stack of EI laminations. The center leg of the core is configured for defining a pair of magnetic paths, one being a relatively low reluctance saturable path and the other a relatively high reluctance non-saturating path. A primary winding, connected to a source of unregulated voltage, is wound upon the center legs for coupling with both magnetic paths. A pair of secondary windings, connected in series opposing relationship across a load, are wound about the center leg each coupling with only one of the magnetic paths to produce a substantially constant output voltage. Since no windings are provided on the outer leg of the EI core structure, the transformer is effectively shielded thereby and thus produces relatively negligible stray magnetic fields.

DESCRIPTION OF THE PREFERRED EMBODIMENT

Figure 1:
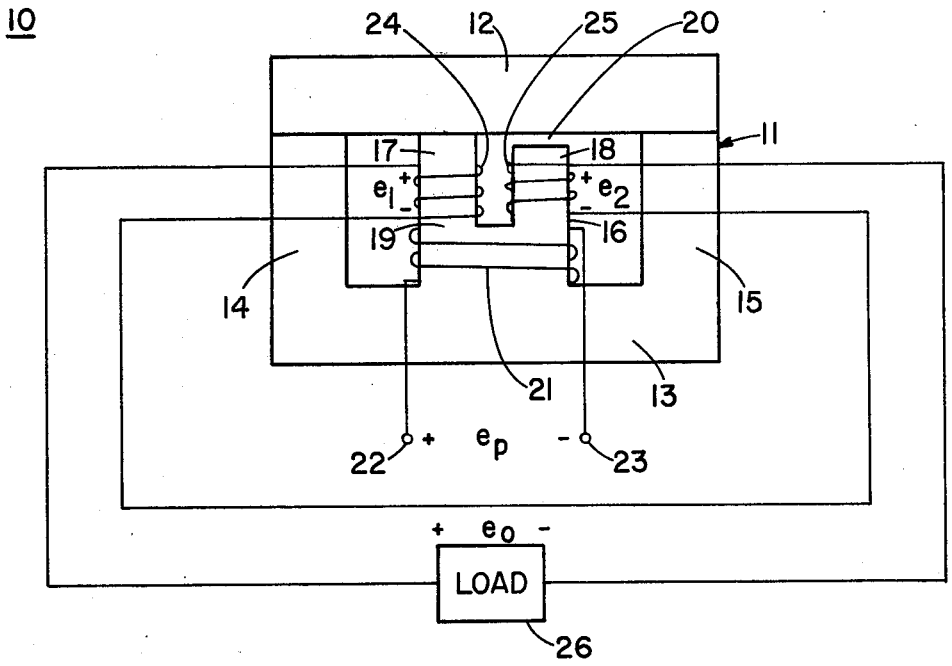
FIG. 1 is a schematic diagram illustrating one embodiment of the voltage regulating transformer of the present invention.

Referring now to the drawings and, in particular, to FIG. 1, there is shown one embodiment of a shell-type transformer 10 according to the present invention. As the term is used herein, a shell-type transformer refers to a transformer shielded for substantially confining the magnetic fields produced thereby and is to be distinguished from a core-type transformer which is substantially unshielded. According to this definition, a transformer having a conventional EI core structure is of the shell-type when no windings are included on the outside legs of the core. On the other hand, the transformer would be of the core-type if windings were located on the outer legs of the core.

With reference to FIG. 1, it will be seen that transformer 10 comprises a magnetic core 11 consisting of a stack of I-shaped laminations forming a core bar 12 suitably secured to a stack of E-shaped laminations 13. E-shaped laminations 13 include a pair of outer legs 14, 15 disposed in abutting relation with core bar 12 and a center leg 16 comprising a bifurcated portion forming a pair of branch legs 17, 18 and an unbifurcated portion 19. Branch leg 17 is disposed in abutting relation with core bar 12 whereas branch leg 18 is spaced therefrom by an air-gap 20.

A primary or input winding 21 is located on unbifurcated portion 19 of center leg 16 and includes a pair of terminals 22, 23 for connection to a souce of unregulated alternating voltage $e_p$. It will be appreciated that unregulated voltage $e_p$ may fluctuate or vary substantially from time to time. When primary winding 21 is energized by the source of unregulated voltage $e_p$, a magnetic flux is induced in center leg 16 following a first path P1 defined by branch leg 17 and the return path consisting of outer leg 14 and a second path P2 defined by branch leg 18 and the return path consisting of outer leg 15. Due to the presence of air-gap 20, path P2 presents a relatively high reluctance to the induced lux whereas, up to the point where outer leg 14 saturates, path P1 is characterized by a relatively low value of reluctance. Consequently, prior to saturation of outer leg 14, most of the flux induced in center leg 16 follows path P1 and a relatively small amount follows path P2. However, as the primary voltage $e_p$ is increased to a level saturating outer leg 14, the flux induced in center leg 16 by primary winding 21 can no longer be returned through leg 14 alone which opposes any further increase in flux. Under these conditions, i.e. saturation of outer leg 14, the reluctance of path P1 becomes comparable to the reluctance of path P2 and the flux induced in center leg 16 divides more nearly equally between the two paths.

Transformer 10 includes an output circuit consisting of secondary windings 24, 25 for developing voltages $e_1$ and $e_2$ for application to a load 26 in response to the flux induced by primary winding 21 in center leg 16. Secondary winding 24 comprises a main secondary winding located on branch leg 17 for magnetically coupling with and developing an induced voltage $e_1$ in response to flux following magnetically saturable path P1. Secondary winding 25 on the other hand, comprises a bucking winding located on branch leg 18 for magnetically coupling with and developing an induced voltage $e_2$ in response to flux following non-saturating path P2. To facilitate the voltage regulation function, bucking winding 25 is connected in series with main secondary winding 24 across load 26 so that induced secondary voltage $e_2$ opposes induced secondary voltage $e_1$. In other words, the voltage $e_0$ developed across load 26 consists of secondary voltage $e_1$ minus secondary voltage $e_2$.

Figure 2:
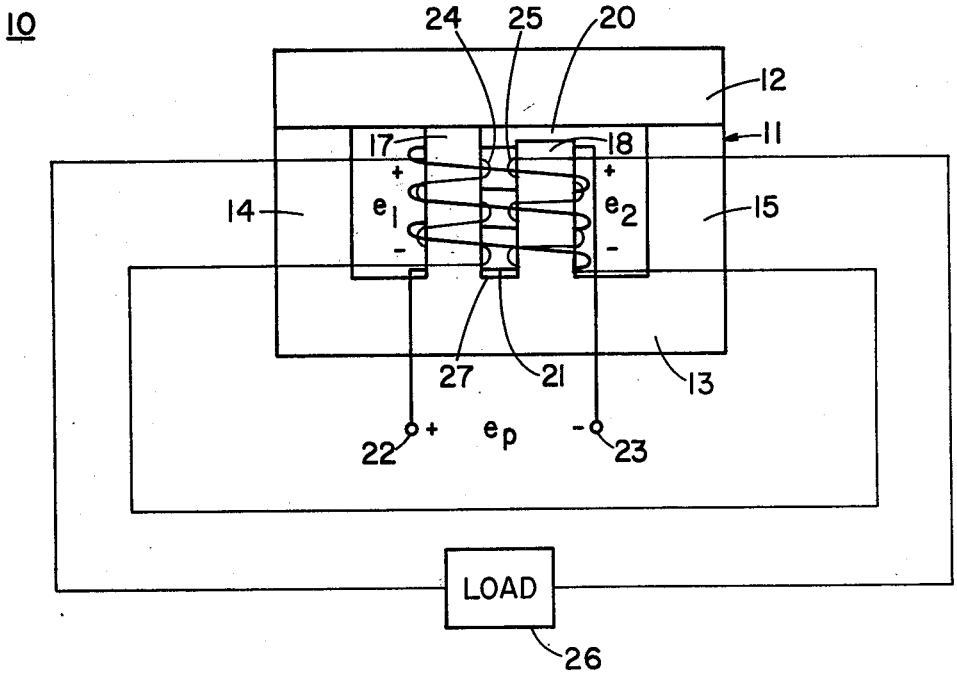
FIG. 2 is a schematic diagram illustrating another embodiment of the voltage regulating transformer of the present invention.

The transformer arrangement illustrated in FIG. 2 is basically similar to that shown in FIG. 1, the essential difference being that the point of bifurcation defining branch legs 17 and 18 extends to the root 27 of center leg 16. Thus, branch legs 17, 18 extend the entire length of center leg 16 eliminating the unbifurcated portion 19 shown in FIG. 1. As in the case of the FIG. 1 embodiment, branch leg 17 is disposed having an end in abutting relation with core bar 12 whereas branch leg 18 is slightly spaced therefrom by air-gap 20. Primary winding 21 is wound about both branch legs 17, 18 while main secondary winding 24 is wound about un-gapped branch leg 17 for magnetically coupling with path P1 and inducing secondary voltage $e_1$. Bucking secondary winding 25 is wound about gapped branch leg 18 for magnetically coupling with path P2 and develops secondary voltage $e_2$. Saturating and non-saturating flux paths P1 and P2 have characteristics substantially identical to those described with respect to FIG. 1 and, as in FIG. 1, secondary windings 24 and 25 are connected in series opposing relationship across load 26 for producing a regulated output voltage $e_0$.

Figure 5:
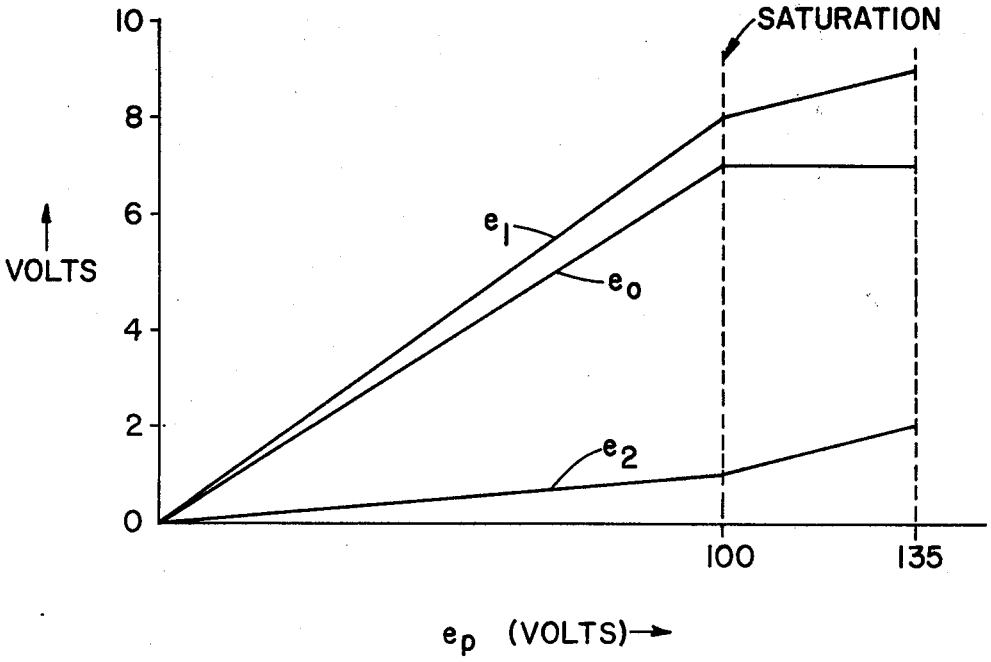
FIG. 5 is a graph illustrating the relationship between the voltages on the windings of the transformers illustrated in FIGS. 1–4.

The operation of voltage regulating transformer 10 may be conveniently explained with the aid of the graph shown in FIG. 5 which depicts the relationship between output voltage $e_0$ and secondary voltages $e_1$ and $e_2$ for a range of input or primary voltage values $e_p$. For purposes of an exemplary showing, it is assumed in FIG. 5 that outer leg 14 of E-shaped laminations 13 magnetically saturates at an input voltage of about 100 volts and that it is desired to maintain a substantially constant output voltage $e_0$ for input voltage variations between about 100 volts and 135 volts. Also, it will be appreciated that the voltage variations shown in FIG. 5 represent a qualitative interpretation of the operation of the transformer. Due to the phenomenon of magnetic saturation occurring in the regulator, the actual waveforms represented by the curves of FIG. 5 are severely distorted and difficult to analyze. The curves of FIG. 5, which neglect these waveform distortions, nevertheless properly and with sufficient accuracy for descriptive purposes represent the operation of the transformers shown in FIGS. 1 and 2.

As mentioned previously, when primary winding 21 is energized from the source of unregulated voltage $e_p$ a magnetic flux is induced in center leg 16. As the input voltage $e_p$ rises from zero toward the 100 volt level, path P1 is characterized by a relatively low reluctance and, therefore, most of the flux follows this path to the substantial exclusion of path P2. Consequently, secondary voltage $e_1$ developed by main secondary winding 24 increases rapidly while the opposing secondary voltage $e_2$ developed by bucking winding 25 increases at a much reduced rate. The output voltage $e_0$, which equals secondary voltage $e_1$ minus secondary voltage $e_2$, therefore generally tracks secondary voltage $e_1$.

For values of primary voltage $e_p$ ranging between 100 volts and 135 volts outer leg 14 of core 11 operates above the knee of its magnetization curve and is said to be saturated. Because of the saturated condition of leg 14, path P1 will oppose any further increase in flux and thus a large change in primary voltage $e_p$ produced a relatively small change in secondary voltage $e_1$. For example, it will be noted that a change in primary voltage $e_p$ from 100 to 135 volts corresponds to a one volt change in secondary voltage $e_1$. Moreover, in its saturated condition, the reluctance of path P1 increases to a level comparable to the reluctance of path P2 whereby the flux induced in center leg 16 now divides more nearly equally between the two paths. As a result, for input voltage ranging between 100 and 135 volts, secondary voltage $e_2$ varies proportionally to secondary voltage $e_1$ substantially offsetting any change in voltage generated by main secondary winding 24. Consequently, the voltage $e_0$ developed across load 26 by the two secondary windings will remain substantially constant over a relatively wide range of primary voltage variations.

Figure 3:
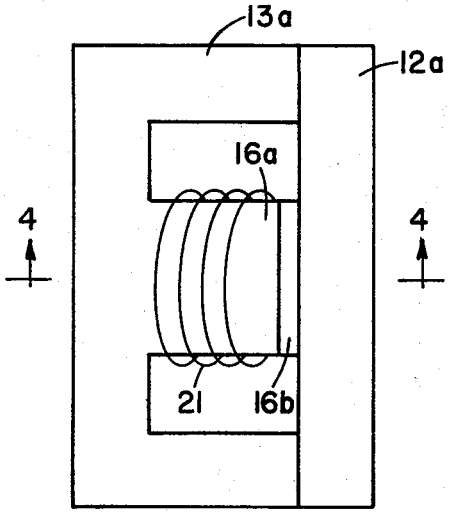
FIG. 3 is a plan view illustrating yet another embodiment of the voltage regulating transformer of the present invention.
Figure 4:
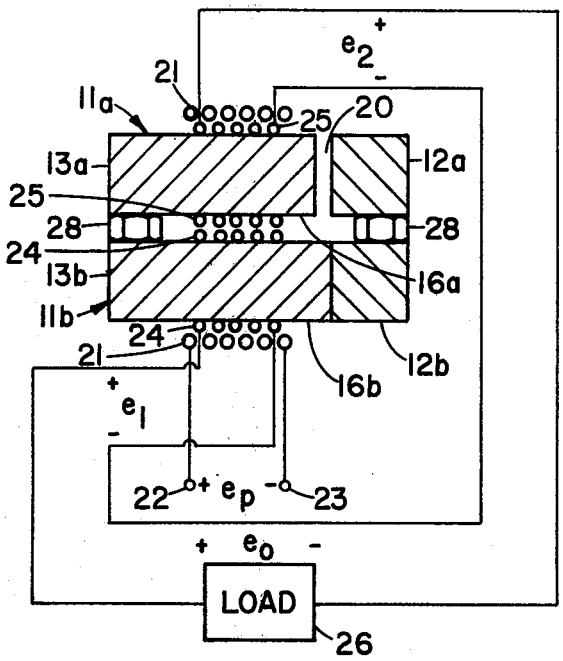
FIG. 4 is a cross sectional view taken along line 4—4 of FIG. 3 and showing, in schematic diagram form, the electrical connections of the transformer of FIG. 3.

Another embodiment of a voltage regulating transformer according to the present invention is shown in FIGS. 3 and 4. Although this transformer arrangement operates substantially indentically to those previously discussed it is configured somewhat differently. Primarily, instead of bifurcating center leg 16 to form flux paths P1 and P2, the transformer shown in FIGS. 3 and 4 achieves the same result in a structure comprising a pair of magnetic cores 11*a* and 11*b* which may be spaced from each other by a plurality of bushings 28 or the like. Magnetic cores 11*a* and 11*b* each comprise a stack of I-shaped lamination forming core bars 12*a* and 12*b* suitably secured to E-shaped laminations 13*a* and 13*b* respectively. The outer legs of E-shaped laminations 13*b* as well as its center leg 16*b* are disposed in abutting relation with core bar 12*b*. On the other hand, while the outer legs of E-shaped laminations 13*a* are disposed in abutting relation with core bar 12*a*, its center leg 16*a* is spaced therefrom by air-gap 20. It will therefore be appreciated that magnetic core 11*b* defines saturable flux path P1 while magnetic core 11*a* defines high reluctance non-saturating flux path P2.

In order to properly couple with paths P1 and P2 primary winding 21 is wound circumscribing center legs 16*a* and 16*b* of both magnetic cores 11*a* and 11*b*. Therefore, the primary winding is magnetically coupled to both paths P1 and P2. Main secondary winding 24 is wound about center leg 16*b* of core 11*b* for magnetically coupling only with path P1 while bucking winding 25 is located about center leg 16*a* of core 11*a* for magnetically coupling only with path P2. And, as before, the two secondary windings are connected in series opposing relationship across load 26.

What has been shown is a novel saturable reactor voltage regulating transformer. The transformer, which is easily and inexpensively manufactured, is characterized by a shell-type construction wherein all of the windings are located on the center leg of the E-shaped laminations to provide shielding against the radiation of stray magnetic fields.

While a particular embodiment of the present invention has been shown and described, it will be obvious to those skilled in the art that various changes and modifications may be made without departing from the invention in its broader aspects. The aim in the appended claims is therefore to cover all such changes and modifications as may fall within the true spirit and scope of the invention.

What is claimed is:

1. A shell-type voltage regulating transformer for use with a substantially constant impedance load comprising:

a magnetic core comprising a stack of EI laminations with a center portion having a pair of legs, one leg defining a first magnetic path characterized by a relatively low reluctance, the other leg including a high reluctance section and defining a second magnetic path characterized by a relatively high reluctance:

a primary winding wound about said center portion for coupling with both of said magnetic paths;

a first secondary winding wound about said one leg for coupling only with said first magnetic path; and a secondary winding wound about said other leg for coupling with said second magnetic path, said secondary windings being connected in series opposing relationship across said load.

2. A transformer according to claim 1 wherein said center portion has a bifurcated section forming said pair of legs.

3. A transformer according to claim 2 wherein said first leg has an end disposed in abutting relationship with said I laminations and said second leg has an end spaced from said I laminations.

4. A transformer according to claim 3 wherein said primary winding is wound about said unbifurcated section and said first and secondary windings are wound about respective ones of said legs.

5. A transformer according to claim wherein said bifurcated section extends substantially along the entire length of said center portion, said primary winding being wound about both said legs and said first and second secondary windings being wound about respective ones of said legs.

6. A transformer according to claim 1 wherein said center portion of said EI laminations comprise a first group of adjacently stacked EI laminations having an end disposed in abutting relationship with said I laminations and a second group of adjacently stacked EI laminations having an end spaced from said I laminations.

7. A transformer according to claim 6 wherein said primary winding is wound about both said legs and said first and second secondary windings are wound about respective ones of said legs.

* * * * *